US006854986B2

(12) United States Patent
Weiss

(10) Patent No.: US 6,854,986 B2
(45) Date of Patent: Feb. 15, 2005

(54) VERY HIGH BANDWIDTH ELECTRICAL INTERCONNECT

(75) Inventor: Roger E. Weiss, Foxboro, MA (US)

(73) Assignee: Paricon Technologies Corporation, Fall River, MA (US)

( * ) Notice: Subject to any disclaimer, the term of this patent is extended or adjusted under 35 U.S.C. 154(b) by 0 days.

(21) Appl. No.: 10/289,744

(22) Filed: Nov. 7, 2002

(65) Prior Publication Data

US 2003/0207608 A1 Nov. 6, 2003

Related U.S. Application Data

(60) Provisional application No. 60/377,300, filed on May 2, 2002.

(51) Int. Cl.[7] ..... H01R 4/58
(52) U.S. Cl. ..... 439/91
(58) Field of Search ..... 439/91, 67, 396

(56) References Cited

U.S. PATENT DOCUMENTS 4,832,051 A * 5/1989 Jarvik et al. ..... 607/116
2002/0180572 A1 * 12/2002 Kakehashi et al. ..... 335/296
2003/0176083 A1 * 9/2003 Li et al. ..... 439/66

* cited by examiner

*Primary Examiner*—J. F. Duverne
(74) *Attorney, Agent, or Firm*—Brian M. Dingman, Esq.; Mirick, O'Connell, DeMallie & Lougee

(57) ABSTRACT

A very high bandwidth electrical interconnect for conducting signals at high frequency. The interconnect includes a number of separate fine wire structures. Each such fine wire structure is made up of a string of generally spherical elements, each such element having a ferromagnetic core and a conductive coating over the core. The interconnect also includes an insulating medium surrounding the wire structures.

17 Claims, 4 Drawing Sheets

VERY HIGH BANDWIDTH ELECTRICAL INTERCONNECT

CROSS REFERENCE TO RELATED APPLICATION

This application claims priority of Provisional application Ser. No. 60/377,300, filed on May 2, 2002.

FIELD OF THE INVENTION

This invention relates to very high bandwidth electrical interconnects.

BACKGROUND OF THE INVENTION

The speed (frequency) of electronic systems continues to increase. Today's computers run at speeds in excess of two GHz, and speeds that are an order of magnitude higher are predicted to be available in the next five years. As the speed of these systems increase, the demand on the electronic interconnect at all levels will be increased to a level beyond the capability of today's interconnection technology. The reason for this is that the impedance of the interconnect rapidly increases with frequency due to the geometric constraints of present technologies. Specifically, the impedance of a conductor will increase with frequency due to a physical phenomenon called "skin effect". Skin effect is the tendency of alternating currents to flow near the surface of a conductor, thus being restricted to a small part of the total sectional area and producing the effect of increasing the impedance. Skin effect is frequency dependent, resulting in most interconnection systems becoming unusable at high frequency due to this increase in impedance.

The skin effect phenomenon can be minimized by greatly reducing the diameter of the conductor. One example of this is known as the "Litzendraht wire" or more commonly the "Litz wire". A Litz wire is a woven stranded wire conductor comprised of many, separate fine diameter wires that are electrically insulated from one another other. This structure has a large amount of surface area for a given cross sectional area. As a result, the available surface for conduction with increasing frequency reduces much more slowly than with a solid conductor or stranded conductor with un-insulated strands. Although the Litz wire method works well in certain applications, it is costly to implement and has limited use.

SUMMARY OF THE INVENTION

It is therefore a primary object of this invention to provide an electrical interconnect that is not overwhelmed by high impedance at speeds over two GHz.

This invention features a very high bandwidth electrical interconnect for conducting signals at high frequency comprising a plurality of fine wire structures, each comprising a string of generally spherical elements; and an insulating medium surrounding the wire structures.

The interconnect can be used for frequencies above two GHz and up to at least 40 GHz. The interconnect may comprise multiple fine wire structures in parallel as a high frequency conducting medium.

The elements may comprise a magnetic or ferromagnetic core. The elements may further comprise a conductive coating over the core. The core can be conductive but need not be, as at high frequency the current flow is fully or primarily in the conductive coating. The coating may comprise a material softer than that of the core. The core may comprise nickel and the coating may comprise silver. The elements may contact each other over an area ranging from about 1% to about 70% of the particle diameter. The elements may comprise separate particles. The elements may comprise overlapping generally spherical wire portions that together create an hourglass profile. The wire structures may be integral.

Also featured is a method of constructing an electrical interconnect for high frequency conduction, comprising providing a plurality of generally spherical particles that are conductive and magnetic or ferromagnetic, mixing the particles with an uncured insulating resin, exposing the mixture to a magnetic field that defines a plurality of generally parallel and spaced magnetic field lines, to align the particles along the field lines into a series of aligned, touching conductive particles that make tangential contact with one another, to form a plurality of fine wire structures, and, while the mixture is exposed to the magnetic field, at least partially curing the resin, to hold the wire structures in place and electrically insulate them from one another.

BRIEF DESCRIPTION OF THE DRAWINGS

Other objects, features and advantages will occur to those skilled in the art from the following description of the preferred embodiments and the accompanying drawings in which.

DESCRIPTION OF THE PREFERRED EMBODIMENTS OF THE INVENTION

Figure 1:
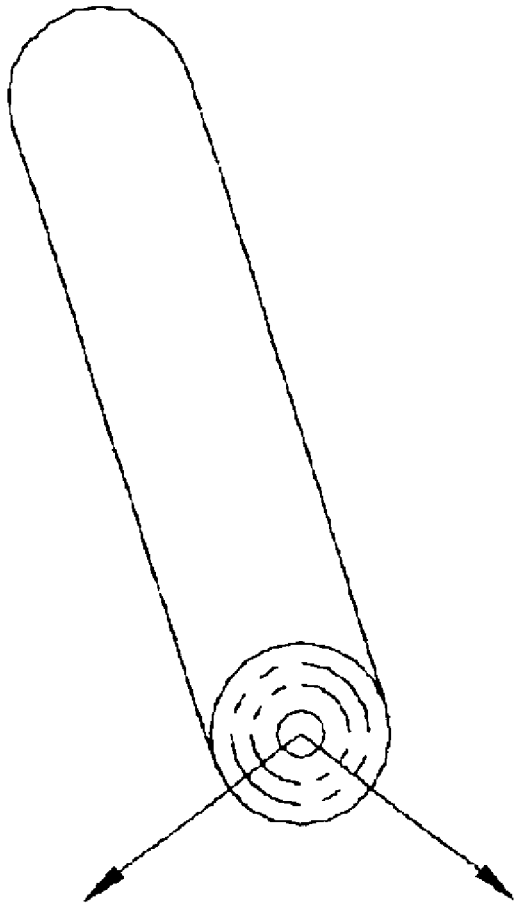
Prior Art Figure 1
FIG. 1 is a schematic, cross-sectional diagram of a prior art connector, illustrating a problem with such connectors at high frequencies.

The invention comprises an interconnect with very good, high speed electrical properties, but can be implemented in a broad set of applications at a much lower cost than a Litz wire. FIG. 1 depicts a portion of a conventional wire of uniform diameter. The concentric circles shown on the end of the wire are to indicate the fact that the useable cross-sectional area of the wire reduces with increasing frequency.

Figure 2:
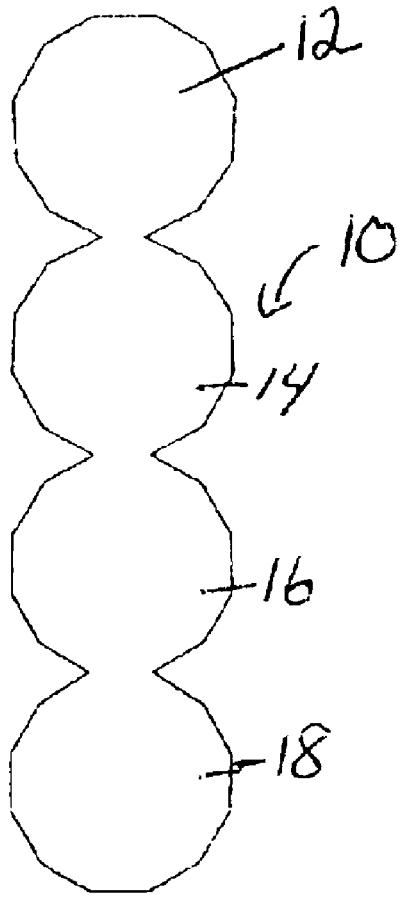
FIG. 2 is a greatly enlarged, partial side view of a wire for the invention.

FIG. 2 schematically depicts a greatly enlarged conductor of this invention. Conductor 10 comprises a string of generally spherical conducting elements 12, 14, 16 and 18 aligned so as to form a fine wire structure comprising a conducting chain. Connection between adjacent elements of the conducting chain occurs in a small zone of tangency that has a very small but non-zero radius. The small radius of this connection zone creates a virtually frequency independent, constant impedance, conducting structure. These wires have very constant performance up to at least 40 GHz.

Figure 3:
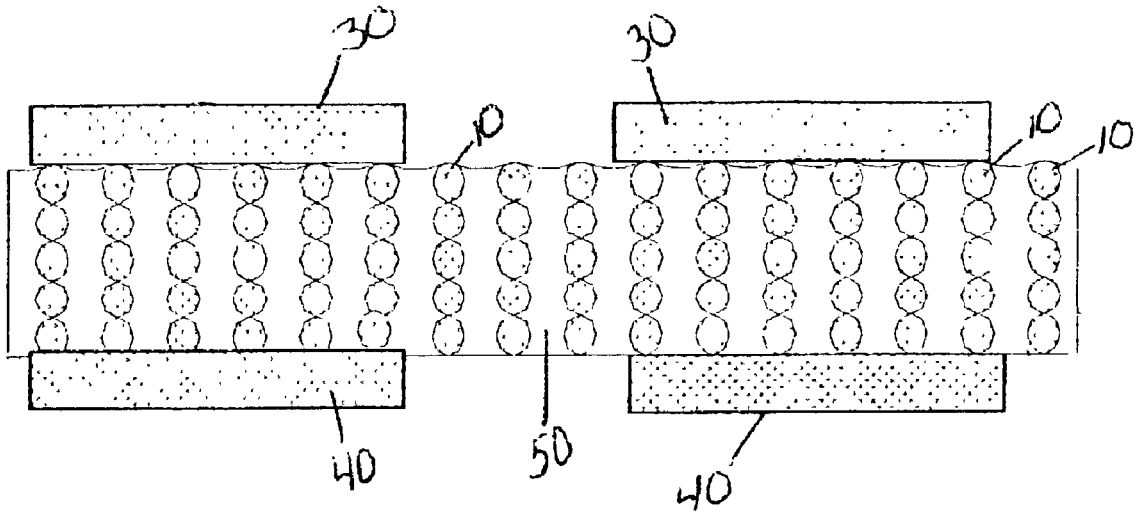
FIG. 3 is a greatly enlarged, schematic, partial side view of a preferred embodiment of the invention.

FIG. 3 presents a multiplicity of such conducting chains 10 used, in parallel, to electrically interconnect two circuit elements 30 and 40. Each conducting chain 10 is electrically isolated from its neighbor by an insulating medium 50 that both provides electrical insulation and serves to hold the conducting chains in place. In one typical application, the diameter of each sphere of a conducting chain may be between 15 and 80 microns, with coatings ranging in thickness from 0.5 to 2.0 microns. The size of the zone of tangency may range from about 15% to about 70% of the particle diameter.

Although the conducting chain structure described above can be constructed in numerous ways, the following method is preferred. Spherical particles which have ferromagnetic properties are blended with an uncured, non-conducting, polymer resin. The uncured particle/resin mixture is extruded into a sheet format and placed in a magnetic field such that the field lines are perpendicular to the sheet. Under the influence of the field, the particles will form into strings of adjacent spheres falling along the field lines. These conducting chains will behave as dipole magnets and tend to repel each other, resulting in a generally uniform distribution of conducting chains throughout the sheet. While being held in this orientation, the polymer is cured sufficiently to freeze in the geometry of the conducting chains.

The hourglass profile of the wire structures effectively comprises overlapping, general spherical wire portions. These wire portions can be integral parts of an integral wire, or separate particles that are maintained in electrical contact with one another. The contact can be maintained as a result of the surrounding resin. Alternatively, the particles can be fused, for example by using a solder coating and sufficiently heating the wires to melt the solder.

Figure 4:
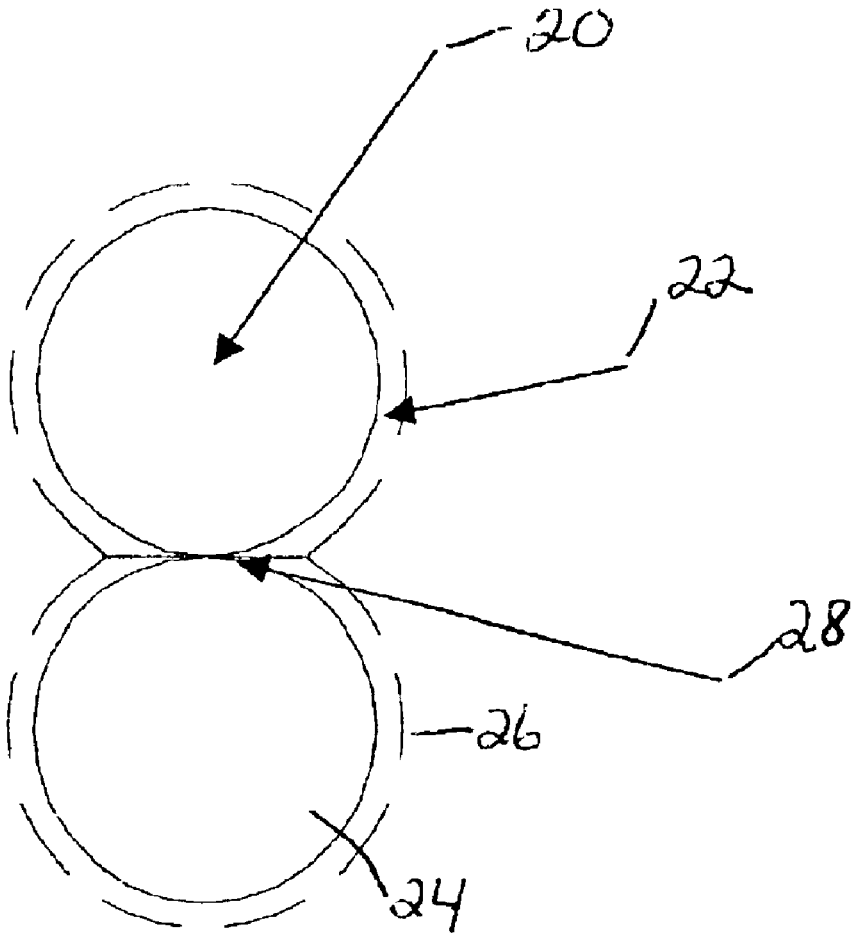
FIG. 4 is a greatly enlarged, schematic side view of two of the generally spherical elements of the preferred embodiment of the wire for this invention.

In an alternative preferred embodiment, highly spherical, silver-plated nickel particles are used to form the inventive wire. The ferromagnetic nickel spherical conductive elements 20 and 24 exhibit the needed magnetic properties for chain formation. The silver coating 22, 26, respectively, provides both environmental protection and a controlled radius contact region 28 in the particle chain, as indicated in FIG. 4; under compression the softer silver deforms at contact region 28 to create the small, non-tangential contact area, while the nickel remains spherical, thus limiting the size of contact region 28.

The insulating polymer medium in which the chains are embedded could be epoxy or silicone. Furthermore, the epoxy could be partially cured, creating what is referred to as a sheet of "B stage" epoxy. This could be used as a high frequency adhesive, for example to bond a chip to a board without solder. Since an adhesive is used, another advantage of this approach is that there is no need to add underfill after soldering.

Although specific features of the invention are shown in some drawings and not others, this is for convenience only as some feature may be combined with any or all of the other features in accordance with the invention.

Other embodiments will occur to those skilled in the art and are within the following claims.

What is claimed is:

1. A very high bandwidth electrical interconnect for conducting signals at high frequency comprising:

a plurality of fine wire structures, each comprising a string of generally spherical elements, wherein the elements comprise a magnetic or ferromagnetic core and a conductive coating over the core; and an insulating medium surrounding the wire structures.

2. The interconnect of claim 1 used for frequencies above two GHz.

3. The interconnect of claim 1 comprising multiple fine wire structures in parallel as a high frequency conducting medium.

4. The interconnect of claim 3 for frequencies in excess of two GHz.

5. The interconnect of claim 1 wherein the coating comprises a material softer than that of the core.

6. The interconnect of claim 5 wherein the core comprises nickel.

7. The interconnect of claim 6 wherein the coating comprises silver.

8. The interconnect of claim 1 wherein the core is conductive.

9. The interconnect of claim 1 wherein the core is a ceramic.

10. The interconnect of claim 1 wherein the elements contact each other over an area ranging from about 1% to about 70% of the particle diameter.

11. The interconnect of claim 1 wherein the elements comprise separate particles.

12. The interconnect of claim 1 wherein the elements comprise overlapping generally spherical wire portions that together create an hourglass profile.

13. The interconnect of claim 12 wherein the wire structures are integral.

14. The interconnect of claim 2 used for frequencies from 2–40 GHz.

15. A method of constructing an electrical interconnect for high frequency conduction, comprising:

providing a plurality of generally spherical particles that are conductive and ferromagnetic, the particles having a ferromagnetic core and a conductive layer over the core;

mixing the particles with an uncured insulating resin;

exposing the mixture to a magnetic field that defines a plurality of generally parallel and spaced magnetic field lines, to align the particles along the field lines into a series of aligned, touching conductive particles that make tangential contact with one another, to form a plurality of fine wire structures; and while the mixture is exposed to the magnetic field, at least partially curing the resin, to hold the wire structures in place and electrically insulate them from one another.

16. A very high bandwidth electrical interconnect for conducting signals at high frequency comprising:

a plurality of fine wire structures, each comprising a string of generally spherical elements, wherein the elements comprise a magnetic or ferromagnetic core and a conductive coating over the core and wherein the elements contact each other over an area ranging from about 1% to about 70% of the particle diameter; and an insulating medium surrounding the wire structures.

17. A very high bandwidth electrical interconnect far conducting signals at high frequency comprising:

a plurality of fine wire structures, each comprising a string of generally spherical separate particles, wherein the particles comprise a nickel core and a conductive coating over the core, wherein the coating comprises a material softer than nickel; and an insulating medium surrounding the wire structures.

* * * * *